United States Patent [19]

Gertsch

[11] 4,022,492

[45] May 10, 1977

[54] RELEASE-SKI BINDING

[75] Inventor: Ulrich Gertsch, Matten, Switzerland

[73] Assignee: Gertsch AG, Zug, Switzerland

[22] Filed: Dec. 3, 1975

[21] Appl. No.: 637,304

[30] Foreign Application Priority Data

Dec. 31, 1974 Switzerland ..... 17408/74

[52] U.S. Cl. ..... 280/618; 280/11.36

[51] Int. Cl.[2] ..... A63C 9/086

[58] Field of Search ..... 280/618, 620, 611, 11.36

[56] References Cited

UNITED STATES PATENTS

| | | | |
|---|---|---|---|
| 3,753,571 | 8/1973 | Gertsch | 280/618 |
| 3,870,325 | 3/1975 | Davis | 280/611 |
| 3,888,499 | 6/1975 | Gertsch et al. | 280/617 |
| 3,893,683 | 7/1975 | Gertsch | 280/611 |

*Primary Examiner*—Joseph F. Peters, Jr.
*Assistant Examiner*—David M. Mitchell
*Attorney, Agent, or Firm*—Martin A. Farber

[57] ABSTRACT

A release-ski binding with a release plate releasably connected with the ski boot, the release plate being releasably anchored at its both ends on the ski, characterized by a lever arrangement acting on the release plate, which on the one hand is set to be coupled with the leg of the skier above the ankle, and on the other hand stands in operative connection with a spring which tends to hold the rear end of the release plate in engagement with a holding member overlapping this end.

10 Claims, 4 Drawing Figures

RELEASE-SKI BINDING

The present invention relates to a release - ski binding with a release plate releasably connected with the ski boot, the release plate being releasably anchored on its both ends on the ski.

In accordance with an object of the invention, such a releaseable ski binding is characterized by a lever arrangement acting on the release plate, which on the one hand is set to be coupled with the leg of the skier above the ankle, and on the other hand stands in operative connection with a spring, which tends, or is biased to hold the rear end of the release plate in engagement with a holding member overlapping this end. During bending the mentioned lever arrangement acts on the binding, namely during strong or excessive bending of the leg in the sense of a preparation of the release, whereby the binding characteristic is correspondingly changed. In this manner, above all with combined forces and stresses, injury dangers, such as for example, the tendon of Achilles or bone fractures, can be avoided, without requiring for this purpose a compromise with the selection of the binding characteristic.

With the above and other objects in view, the present invention will become more readily understood from the following detailed description of preferred embodiments thereof in connection with the accompaning drawings, in which.

Figure 1:
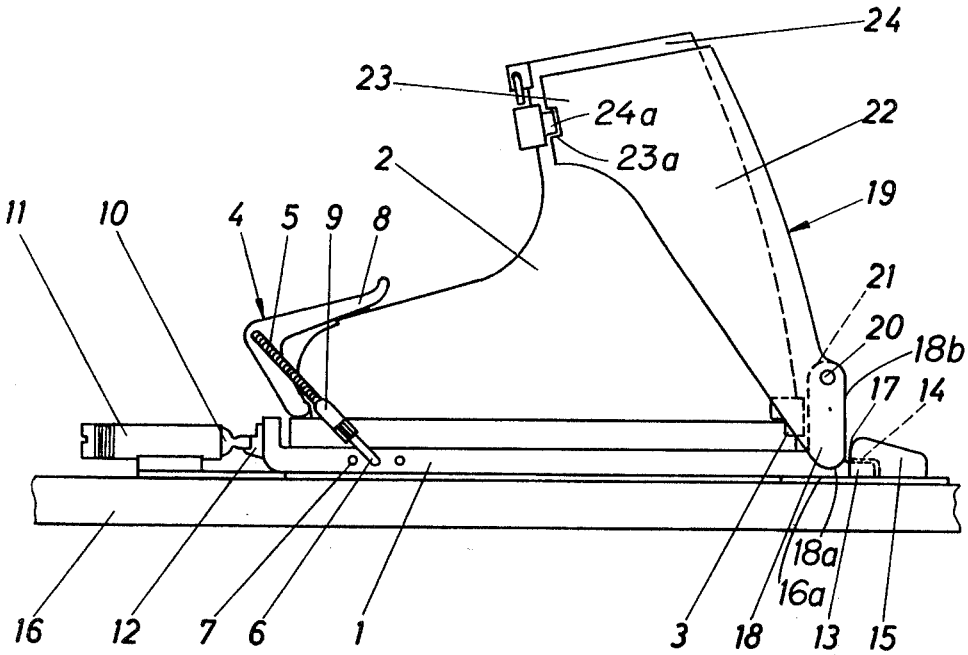
FIG. 1 is a side elevation of a release-ski binding in accordance with the present invention shown in connection with a ski boot and a ski, the latter being partly broken away at the ends.

Referring now to the drawings, and more particularly to the embodiment of FIG. 1, a release plate 1 is connected with the ski boot 2 by means of a heel holder 3 and a sole holder 4, the heel holder 3 being substantially rigidly anchored on the release plate 1. The sole holder 4 includes a bracket 5 which can be anchored with its two angled-ends 6 in holes 7 formed in the release plate 1, as well as includes a clamping lever 8 which overlaps the tip of the sole with one lever arm thereof. In addition to the coarse adjustment guaranteed by means of the holes 7, a fine adjustment of the bracket is guaranteed, as known, by means of a threaded sleeve or screw socket 9.

The front end of the release plate 1 is retained by means of a spring-biased release member 10, which member 10 is universally pivotable in a housing 11 against a spring force, and yet beyond that is mounted displaceable forwardly in the longitudinal direction of the ski. The release member 10 and the end thereof, respectively, in the present case is overlapped by the counter piece 12 of the release plate 1 from below and from both sides, whereby a release toward the rear and toward both sides, respectively, is guaranteed. U.S. Pat. No. 3,489,424, dated Jan. 13, 1970, and incorporated herein by reference, for example, although not limited thereto, illustrates in FIGS. 3–7 thereof such a type of release or locking member.

The rear end 13 of the release plate 1 engages in a recess 14 of a holding member 15, the latter being fixedly anchored on the ski 16, which member 15 thereby overlaps the rear end 13 of the release plate 1 from above and from both sides. The holding member 15 serves with its front face or facing side 17 as an abutment for a shorter arm 18 of a lever arrangement (lever) 19, which is fastened at pivot 20 on a substantially vertical extension or projection 21 of the release plate 1. The projection 21 can simultaneously also be a carrier and support for the heel holder 3, the latter releaseably engaging the heel of the ski boot as indicated. The longer arm 22 of the lever arrangement 19 is fastened on the leg of the skier above the ankle with a sleeve- or collar-like formation 23. Strictly speaking, in the present case the sleeve-like formation 23 clasp-ingly embraces the shaft 24 of the ski boot 2. The longer arm 22 extends along the back of the boot from the pivot 20 adjacent the heel, increasing in girth in an upward direction and completely covers and protects the tendon of Achilles. A recess 23*a* facing the front is formed in the collar 23 in which there cooperatively extends a complementary engagement stud 24*l*, the latter being hinged to the front of the boot 2.

During bending of the leg out of the illustrated normal position, the double-armed lever arrangement 19 is pivoted in the counter-clockwise sense, viewed according to the drawing, whereby the shorter arm 18 becomes supported on the front face side 17 of holding member 15 and the release plate 1 effects by means of the pivot 20, a displacement in the longitudinal direction of the ski toward the front against the force of the spring which acts on the release member 10. In this manner the rear end 13 of the release plate 1 more or less becomes under circumstances completely out of engagement with the holding member 15. During a forward fall or collision thus a release can occur solely with the aid of the lever arrangement 19. Beyond this it is of course possible to bevel or incline the rear end of the release plate from above as well as from both sides, whereby the inclined surfaces in turn aid or encourage the disengagement of the rear end 13 of the release plate 1 from the holding member 15, and facilitate disengagement during side release also without aid or cooperation of the lever arrangement, respectively.

Figure 2:
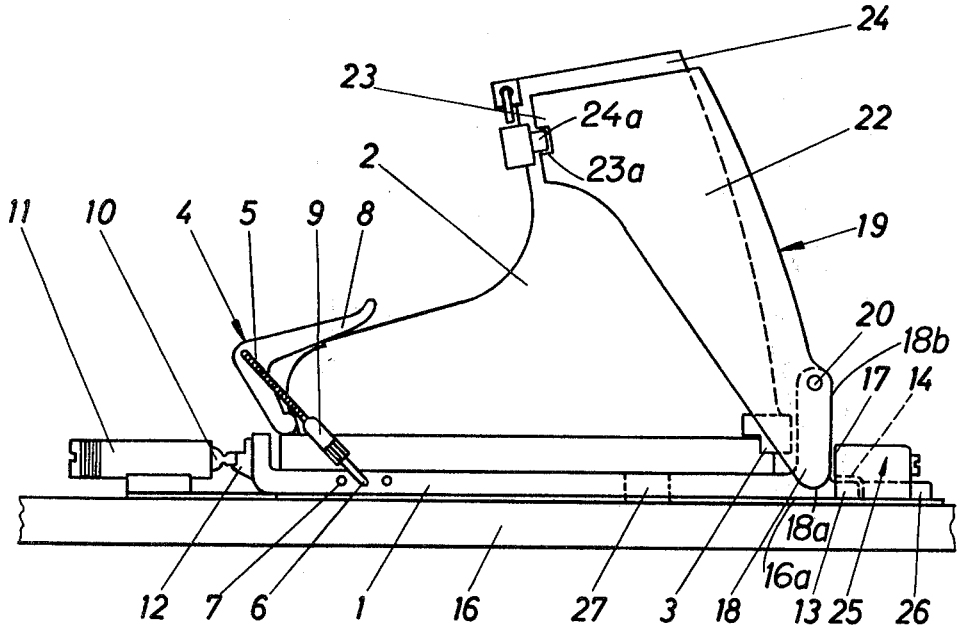
FIG. 2 is a side elevational view of another embodiment of the release-ski binding of the invention shown in connection with a ski boot and a ski, the latter being partly broken away at its ends.

Referring now to the embodiment of FIG. 2 of the drawings, the same parts are designated with the same reference character, it being understood that such parts, as not otherwise indicated, have the same function, accordingly making further description of these parts unnecessary.

FIG. 2 illustrates a difference with respect to the embodiment of FIG. 1, showing a second embodiment of the holding part, here designated with the reference character 25, which is retained on the ski 16 displaceable in the longitudinal direction of the ski by means of a guide 26 on the ski, whereby a spring (not shown) tends or biases the holding member 25 to hold the holding member 25 in its operative or active position as illustrated. In this position the holding member 25 overlaps the rear end 13 of the release plate 1. The latter is laterally pivotably supported on the ski by means of a ski-fixed pivot pin 27 which engages in a corresponding recess in the release plate 1. The release plate 1 is normally retained against a lateral pivoting by the aid of the front release member 10. The holding member 25 is preferably constructed so that it offers, i.e., opposes, no resistance to the lateral pivoting of the release plate 1, that is of a lateral movement of the rear end 13 of the same. It is understood, however, that the mentioned rear end 13 of the release plate 1 is laterally beveled or inclined and can correspondingly or complementarily be overlapped by the holding member 25. Also, the end 13 of the release plate 1 could be upwardly inclined with a corresponding formation of the holding member 25.

With this embodiment, the release plate 1 is not displaced toward the front by means of the lever arrangement 19, but rather the holding member 25 is displaced toward the rear, when the leg of the skier is correspondingly bent. Nothwithstanding, the action of this variant embodiment conforms in sense with that of the first embodiment example.

Numerous further variations in accordance with the present invention are possible within the scope of the invention. For example, but not limited thereto, also with the embodiment according to FIG. 1, a pin 27 fixed to the ski 16 could be provided, which yet in this case then must engage in a longitudinal slot in the release plate 1, in order to make possible a forward displacement of the latter. Preferably, thereby, the pin and the front end of the longitudinal slot would serve as abutments for the release plate 1, whereby these abutments would be supported on each other under the action of the not illustrated spring of the release member 10. Such an embodiment variation of FIG. 1 with a cooperating longitudinal slot, can incorporate by way of example those features of U.S. Pat. No. 3,866,928 which issued on Feb. 18, 1975 and is herein incorporated by reference. The release plate 1 is retained against pivoting about the pin 27 by means of the front release member 10 and/or by means of the rear holding member 15 or 25 in the normal operative holding position.

In all cases in addition to the introductory-mentioned advantages, the possibility is provided for a longitudinal displacement of the release member 10, amongst others, by means of a corresponding adjustment (or selection) of the spring, to provide a larger resistance (certainly without thereby unduely or inadmissibly making more difficult the release to the side or upwardly). In this manner dynamic erroneous or inadvertent release is avoided, whereby yet with an actual forward crash or collision the increased resistance is again raised or balanced against a longitudinal displacement of the release plate 1 with the aid of the lever arrangement 19.

Figure 3:
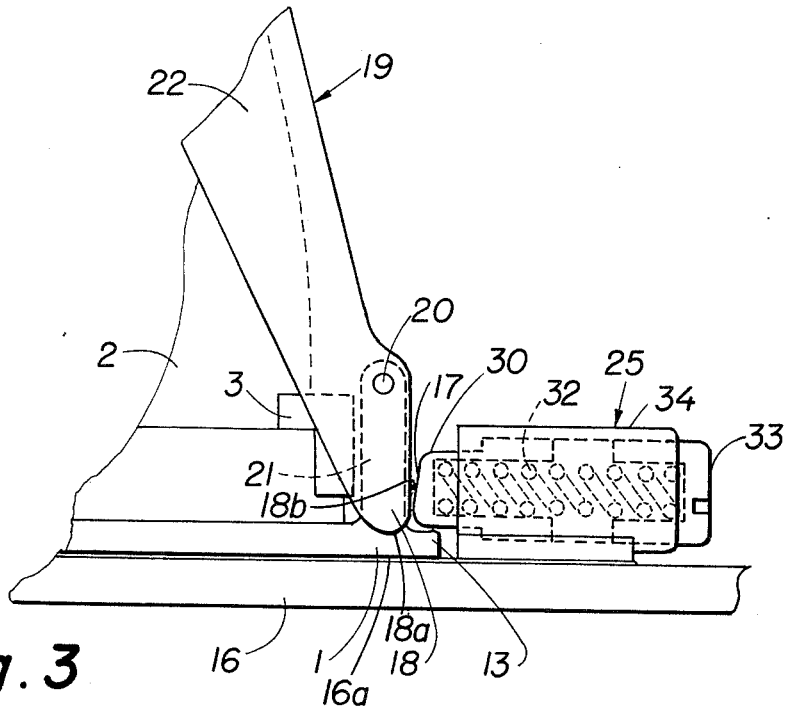
FIGS. 3 and 4 are similar broken away views of rear portions of different embodiments of the binding.

Referring now again to the drawings, and more particularly to FIG. 3, an enlarged detail is shown which can be used with the embodiment of FIG. 2 for the holding member 25. In the embodiment of FIG. 3, a hollow displaceable piston 30 is biased by a spring 32 therein which also abuts an adjustment screw 33, the latter being adjustably screw threaded to cooperating threads in the holding member housing 34. The housing 34 is fixed to the ski 16 and displaceably carries the piston 30. During a bending in the skier's ankle joint, the arm 22 of the lever arrangement 19 pivots frontwards about the axis or shaft connection 20, the short arm 18 however moving rearwardly and pressing the spring piston 30 rearwardly. In this manner the tongue or rear end 13 of the release plate 1 becomes free, and the release plate together with the boot can move upwardly (constituting a geometrically controlled front-fall-release).

Figure 4:
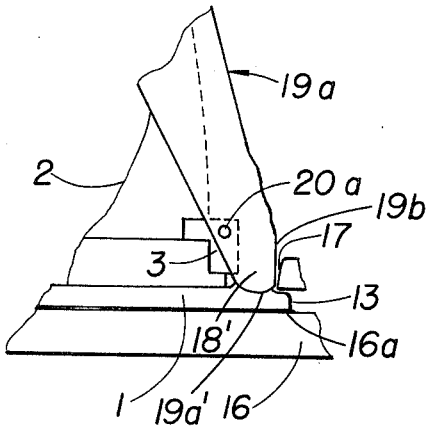

The lever arrangement 19*a* can be fastened or pivoted on the heel holder 3 of the release plate 1 (as indicated in FIG. 4). That is the connection 20*a* connects the lever arrangement 19*a* directly to the heel holder 3, the latter being secured to the release plate 1 rigidly or somewhat yieldable relative thereto. The operation of the lever arrangement 19*a* however is similar to that described in connection with the previous embodiments, the same numerals referring to like parts and functions of the previous figures, and thus not herein again described. The holding devices 15, 25 or 30 of the other embodiments may also be used in combination herewith.

In all embodiments, the pivot connection 20 or 20*a* is spaced further from the upper surface 16*a* of the ski 16 (the upper surface 16*a* of the ski 16 is defined to mean the upper surface of the ski or any element which may be mounted on the ski, on which the release plate sits) than the distance of the pivot 20 or 20*a* from the lowermost portion 18*a* or 19*a'* of the short arm 18 or 18' of the lever arrangement 19 or 19*a*, respectively. In this manner the lowermost end 18*a*, 19*a'* of the lever arrangement is always spaced a distance apart from the upper surface 16*a* even during a release operation and only the rearmost portion 18*b* or 19*b* of the lever arrangement acts to effect the release of the release plate 1, exclusively by operatively engaging the front face side 17 of the rear holding member.

The spring directly biasing the release member 10 and/or the spring directly biasing the rear holding member 25 or 30 in conjunction with the respective release member 10 and the rear holding member 25 or 30 itself hereinafter constitute spring means. While I have disclosed several embodiments of the present invention, it is to be understood that these embodiments are given by example only and not in a limiting sense.

I claim:

1. A release - ski binding for use with a ski having an upper surface and a ski boot, comprising a release plate releasably connected with a ski boot and a ski, respectively, said release plate including a rear end, a rear holding member means for releasably anchoring said release plate at said rear end on said ski, and cooperatively permitting release of said release plate by relative longitudinal movement of said rear holding member means and said release plate, said rear holding member means having a front facing side, spring means for providing a longitudinal force component for operatively holding said rear end of said release plate in engagement with said rear holding member means, lever means for operatively acting on said release plate and for operatively coupling with a leg of a skier above an ankle of the leg, said lever means for being in operative connection with said spring means, said lever means includes a lower arm having a rear side operatively abuttingly engaging said front facing side of said rear holding member means for longitudinally displacing said release plate relative to said rear holding member means against the action of said spring means when said lever means is moved by a bending of the leg so as to release the holding engagement of said rear holding member means from said release plate, and said lower arm having a lowermost end spaced from the upper surface of said ski.

2. The release - ski binding, as in claim 1, further comprising pivot means for pivotally connecting said lever means operatively to said release plate such that said rear side is operatively adjacent said front facing side of said rear holding member means, said pivot means is spaced further from said upper surface of said ski than the distance of said pivot means from said lowermost end of said lower arm of said lever means.

3. The release - ski binding, as in claim 1, wherein said rear holding member means is anchored on said ski, said release plate has a front end, said spring means includes a spring-biased front release member means for operatively engaging said front end of said release plate biasing the latter rearwardly into the holding engagement with said rear holding member means, said front release member means thereby operatively holding said rear holding member means in holding engagement with said rear end of said release plate.

4. The release ski binding, as in claim 1, wherein said rear holding member means overlaps said rear end of said release plate in the operative holding engagement position thereof, said rear holding member means is, displaceably guidedly disposed on said ski, for being displaced out of said operative holding engagement position thereof against the action of said spring means by said rear side of said lower arm operatively abuttingly engaging said front facing side of said rear holding member means.

5. The release - ski binding, as in claim 4, wherein said release plate is formed with a recess spaced from said rear end thereof, a pivot pin rigidly connected to said ski and pivotally disposed in said recess of said release plate.

6. The release - ski binding, as in claim 4, wherein said lever means via said rear side thereof displaces said rear holding member means out of said operative holding engagement position against the action of said spring means when said lever means is actuated by a bending movement of the leg of the skier.

7. The release - ski binding, as in claim 4, wherein said spring means directly biases said rear holding member means in engagement with said rear end of said release plate.

8. The release - ski binding, as in claim 1, further comprising a pivot pin means for laterally pivotally mounting said release plate with respect to said ski, a front release member means for releaseably holding a front end of said release plate on said ski, at least one of said front release member means and said rear holding member means constitutes means for operatively retaining said release plate against pivoting about said pivot pin means.

9. The release - ski binding, as in claim 8, wherein said release plate includes a heel holder means for releaseably holding a heel of said ski boot, and said lever means is operatively pivotally fastened on said heel holder means of said release plate.

10. The release - ski binding, as in claim 1, wherein said lever means comprises a double-armed lever having a longer upper oriented arm constituting a collar substantially encompassing claspingly an upper shaft portion of said ski boot above the ankle of the skier, as well as said lower arm with said rear side disposed operatively adjacent said front facing side of said rear holding member means, pivot means for pivotally connecting said lever means to a rear portion of said release plate, said rear portion constituting an upwardly directed projection thereof, said pivot means is spaced further from said upper surface of said ski than the distance of said pivot means from said lowermost end of said lower arm of said lever means.

* * * * *